US005349708A

United States Patent [19]

Lee

[11] Patent Number: 5,349,708

[45] Date of Patent: Sep. 27, 1994

[54] FOLDABLE KITCHEN SINK

[76] Inventor: Hae-Sup Lee, 1467-16, Seocho-Dong, Seocho-Ku, Seoul, Rep. of Korea

[21] Appl. No.: 138,231

[22] Filed: Oct. 15, 1993

[30] Foreign Application Priority Data

May 25, 1993 [KR] Rep. of Korea ..... 93-9121
Jul. 26, 1993 [KR] Rep. of Korea ..... 93-14023

[51] Int. Cl.[5] ..... E03C 1/186
[52] U.S. Cl. ..... 4/638; 4/631
[58] Field of Search ..... 4/619, 625, 626, 627, 4/630, 631, 632, 637, 638, 639, 640, 643, 644, 650, 652, 653, 654, 656; 312/228, 228.1, 229, 210, 258

[56] References Cited

U.S. PATENT DOCUMENTS

| | | | |
|---|---|---|---|
| 485,743 | 11/1892 | Huss | 4/637 X |
| 2,594,938 | 4/1952 | Leavitt | 4/626 |
| 2,663,392 | 12/1953 | Miller | 4/637 |
| 2,944,862 | 7/1960 | Heil | 4/625 X |
| 3,594,830 | 7/1971 | Clifton | 4/625 |
| 3,993,376 | 11/1976 | Meldahl | 4/630 X |

FOREIGN PATENT DOCUMENTS 554410 7/1932 Fed. Rep. of Germany ..... 312/228

*Primary Examiner*—Charles E. Phillips
*Attorney, Agent, or Firm*—Nawrocki, Rooney & Sivertson

[57] ABSTRACT

A foldable kitchen sink suitable for used as either of an outdoor sink and an outdoor multipurpose table. The foldable kitchen sink comprises a pair of support members hinged to each other to be folded, the pair of support members having a dishwater bucket and a grille, respectively, the dishwater bucket and grille being detachably mounted on the support members. A pair of upper panels are provided at both side ends of each of the support members such that they selectively cover the dishwater bucket or the grille. A pair of twin legs and a pair of single legs are hinged to lower surfaces of the support members such that the twin legs are diagonally opposed to each other and the single legs are diagonally opposed to each other. The twin legs and the single legs are foldable, and each of the twin legs comprises two legs connected to each other by a support beam extending therebetween.

12 Claims, 18 Drawing Sheets

FOLDABLE KITCHEN SINK

BACKGROUND OF THE INVENTION

1. Field of the Invention

The present invention relates in general to a kitchen sink, especially to a portable kitchen sink, and more particularly to a foldable kitchen sink suitable for used as either of an outdoor sink and an outdoor multipurpose table.

2. Description of the Prior Art

It is apparent to those skilled in the art that there have been proposed several types of foldable kitchen sinks such as disclosed in Korean Patent Publication No. 91-194 and Korean Patent Application No. 91-10936, published under Korean Patent Laid-open Publication No. 93-66. However, each of the foldable sinks disclosed in the above Korean patents comprises a plurality of elements, thus to have a substantially complex construction. In this regard, the known foldable kitchen sink has a problem that it requires a complex assembling process, thereby deteriorating the operation efficiency as well as the productivity, and increasing the manufacturing cost.

Especially, the above foldable kitchen sink is folded and unfolded with several steps and, as a result, its folding and unfolding operation is relatively complex. In addition, since the folding structure of this foldable sink comprises a plurality of elements, so that the repeated folding and unfolding operations inevitably cause the folding structure to be out of order, thus to reduce the using life of the foldable kitchen sink. When this foldable kitchen sink is folded, it shows a three stepped side appearance, so that it has such considerable thickness and volume that its management when folded and carried with one is not easy.

SUMMARY OF THE INVENTION

It is, therefore, an object of the present invention to provide a foldable kitchen sink in which the aforementioned problems introduced by the known foldable sink can be overcome and which simplifies its folding structure and reduces its elements, thus to achieve the recent trend of lightness and compactness of the portable sink, and to facilitate its management when folded and carried with one.

It is another object of the present invention to provide a foldable kitchen sink which has a simple construction, thus to simplify its fabrication process, to reduce the manufacturing cost, and has the simple folding structure, thereby reducing the manufacturing cost and preventing the folding structure from being out of order irrespective of long time use, and, as a result, increasing the using life.

It is a further object of the present invention to provide a foldable kitchen sink which is also used as an outdoor multipurpose table, thus to maximize its practicality.

It is yet another object of the present invention to provide a foldable kitchen sink which is simply and easily folded, thus to provide a convenience for the user, and shows a two stepped side appearance when folded, thus to have such compact profile that its management, when folded and carried with one, is easy, In order to accomplish the above objects, a foldable kitchen sink in accordance with the present invention comprises a pair of support members hinged to each other to be folded, the pair of support members having a dishwater bucket and a grille, respectively, the dishwater bucket and grille being detachably mounted on the support members; a pair of upper panels provided at both side ends of each of the support members such that they selectively cover the dishwater bucket or the grille; and a pair of twin legs and a pair of single legs hinged to lower surfaces of the support members such that the twin legs are diagonally opposed to each other and the single legs are diagonally opposed to each other, the twin legs and the single legs being foldable, and each of the twin legs comprising two legs connected to each other by a support beam extending therebetween.

BRIEF DESCRIPTION OF THE DRAWINGS

The above and other objects, features and other advantages of the present invention will be more clearly understood from the following detailed description taken in conjunction with the accompanying drawings, in which:

FIGS. 12 to 16 are front views of the foldable kitchen sink of FIG. 1, respectively, showing the folding operation of the foldable sink from a completely unfolded state to a completely folded state, in which:

FIG. 12 shows the completely unfolded state of the sink;

FIG. 13 shows an upper panel retraction state at which the sink can be used as a multipurpose outdoor table;

FIG. 14 shows a step for folding the grille type rack;

FIG. 15 shows a step for folding the legs; and

FIG. 16 shows a front profile of the sink in the completely folded state wherein the support members are folded and face each other with the legs and the grille type rack folded in therebetween, thus to compact the sink;

FIGS. 17 and 18 show a foldable kitchen sink in accordance with a second embodiment of the present invention., in which:

FIG. 17 is a perspective view of the sink; and

FIG. 18 is a front view of the sink, showing a folding operation of the upper panels;

DESCRIPTION OF THE PREFERRED EMBODIMENTS

Figure 1:
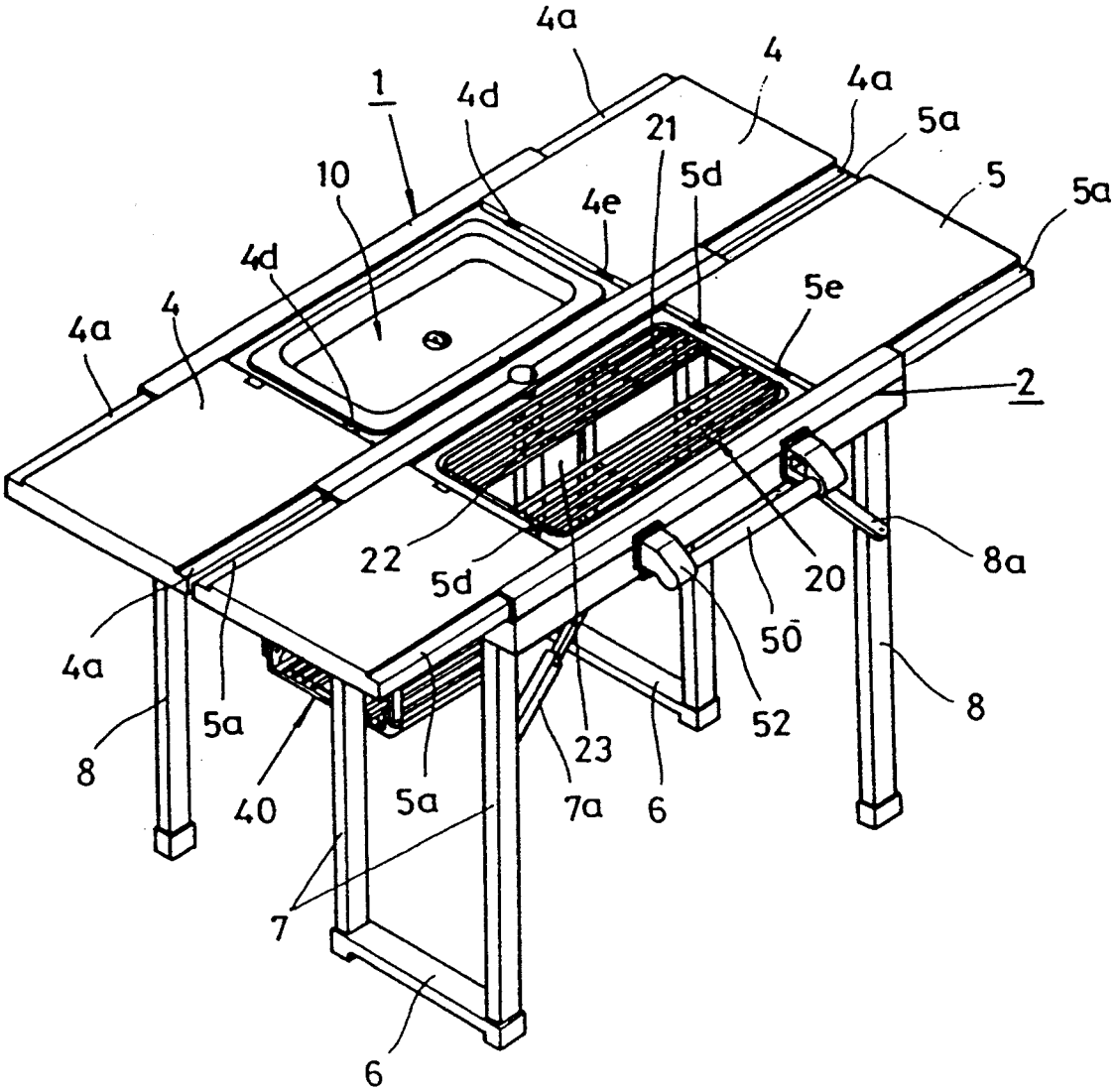
FIG. 1 is a perspective view of a foldable kitchen sink in accordance with a primary embodiment of the present invention, showing the unfolded state of the sink to be used as a sink.

With reference to FIGS. 1 to 16, there is shown a foldable kitchen sink in accordance with a primary embodiment of the present invention. The foldable sink comprises a first support member 1 and a second support member 2 which are hinged to each other by a plurality of hinge connections 3 such that they are folded about the hinge connections 3 to face each other. The first support member 1 supports a dishwater bucket 10 which is detachably seated on a middle section of the first member 1, while the second support member 2 supports a grille 20 which is detachably seated on a middle section of the second member 2. A first upper panel 4 is provided at each side of the first support member 1 such that it slidably reciprocates with respect to the first member 1. In the same manner, a second upper panel 5 is provided at each side of the second support member 2 such that it slidably reciprocates with respect to the second member 2. The foldable kitchen sink further includes a twin leg 7 and a single leg 8 which are hinged to a lower surface of each of the support members 1 and 2, as best seen in FIG. 2, such that they are folded to face the lower surface of the corresponding member 1 or 2. Here, the twin leg 7 comprises two legs 7 which are connected at their lower ends to each other by a support beam 6 extending therebetween, and hinged at their upper tops to the lower surface of the member 1 or 2. Thus, the two twin legs 7 of the members 1 and 2 are diagonally opposed to each other as shown in FIG. 2. In the same manner, the two single legs 8 of the members 1 and 2 are diagonally opposed to each other.

The dishwater bucket 10 is inserted in a rectangular hole 1*a* of the first support member 1 and supported by a bucket seat, defined at the periphery of the hole 1*a*, as shown in FIGS. 1 to 4 and FIG. 9. Here, the second support member 2 is provided with a rectangular hole 2*a* which has the same shape as the hole 1*a* of the first member 1 and receives the grille 20. In the present invention, it should be thus noted that the dishwater bucket 10 may be installed in the second support member 2 instead of the first support member 1, and the grille 20 may be installed in the first support member 1 instead of the second support member 2. Returning to the accompanying drawings, the dishwater bucket 10 has a dishwater drain port 11 which is formed at the bottom center of the bucket 10 and integrally formed with a protruding coupling member having an unidirectional coupling flange 12. Connection of a conventional dishwater drain pipe 14 to the drain port 11 is achieved using an intermediate coupling member 16 which is connected at its lower end to the drain pipe 14 and engages with the coupling member of the drain port 11 at its upper top. In order to bring the intermediate coupling member 16 into engagement with the coupling member of the drain port 11, this coupling member 16 is provided at its upper top with an inward flange for engaging with the unidirectional coupling flange 12.

The grille 20 is inserted in the rectangular hole 2*a* of the second support member 2 and supported by a grille seat, defined at the periphery of the hole 2*a* , as shown in FIGS. 1 to 4 and FIG. 9. This grille 20 comprises a plurality of latitudinal bars 21 and a plurality of longitudinal bars 22 which cross with each other such that a larger latitudinal opening 23 is defined at the center of the grille 20. This latitudinal opening 22 is defined to allow fuel supplying means, for example, a gas hose for supplying gas to a gas range, to pass therethrough.

The hinge connections 3 foldably connecting the two support members 1 and 2 together are spaced out from each other at regular intervals as shown in FIG. 2. Thus, the two support members 1 and 2 are folded about these hinge connections 3 to face each other and unfolded to be practically used out of door.

As shown in FIGS. 1 to 5 and 9 to 11, the first support member 1 has a pair of linear guide rails 1*b* which are provided at the front and rear ends of the member 1, respectively, for guiding a slide reciprocation of the first upper panels 4. In the same manner, the second support member 2 has a pair of linear guide rails 2*b* which are provided to guide a slide reciprocation of the second upper panels 5. In order to achieve the slidable engagement of the upper panels 4 and 5 with individual guide rails 1*b* and 2*a* as well as to level the upper surfaces of the upper panels 4 and 5 with the upper surfaces of the guide rails 1*b* and 2*b*, the panels 4 and 5 are provided with stepped sides 4*a* and 5*a* which are received by the guide rails la and 2*a*, respectively. Each of the upper panels 4 and 5 is also integrally provided with a stopping protrusion 4*b* or 5*b* and a stopping recess 4*c* or 5*c* which are spaced apart from each other by a predetermined distance. In order to cooperate with the stopping protrusions 4*b* and 5*b* and the stopping recesses 4*c* and 5*c* of the upper panels 4 and 5 to limit the slide reciprocation of the panels 4 and 5, a stopper 30 is provided for each of the first and second support members 1 and 2. The stopper 30 is mounted on a lower surface of the member 1 or 2 and passes through a hole 1*c* or 2*c* of the corresponding support member. Thanking for the cooperation of the stopping protrusion 4*b* or 5*b* and the stopping recess 4c or 5c of the upper panel with the stopper 30, the slide reciprocation of the panel 4 or 5 with respect to the corresponding support member 1 or 2 is limited within a range defined by the distance between the stopping protrusion and the stopping recess.

In addition, the facing sides of the pair of upper panels 4 or 5 are provided with a pair of coupling protrusions 4d or 5d and a pair of coupling recesses 4e or 5e, respectively. When the pair of upper panels 4 or 5 closely face each other, the pair of coupling protrusions 4d or 5d are inserted into the pair of coupling recesses 4e or 5e, respectively, thus to couple one of the panels 4 or 5 to the other of the panels.

Figure 2:
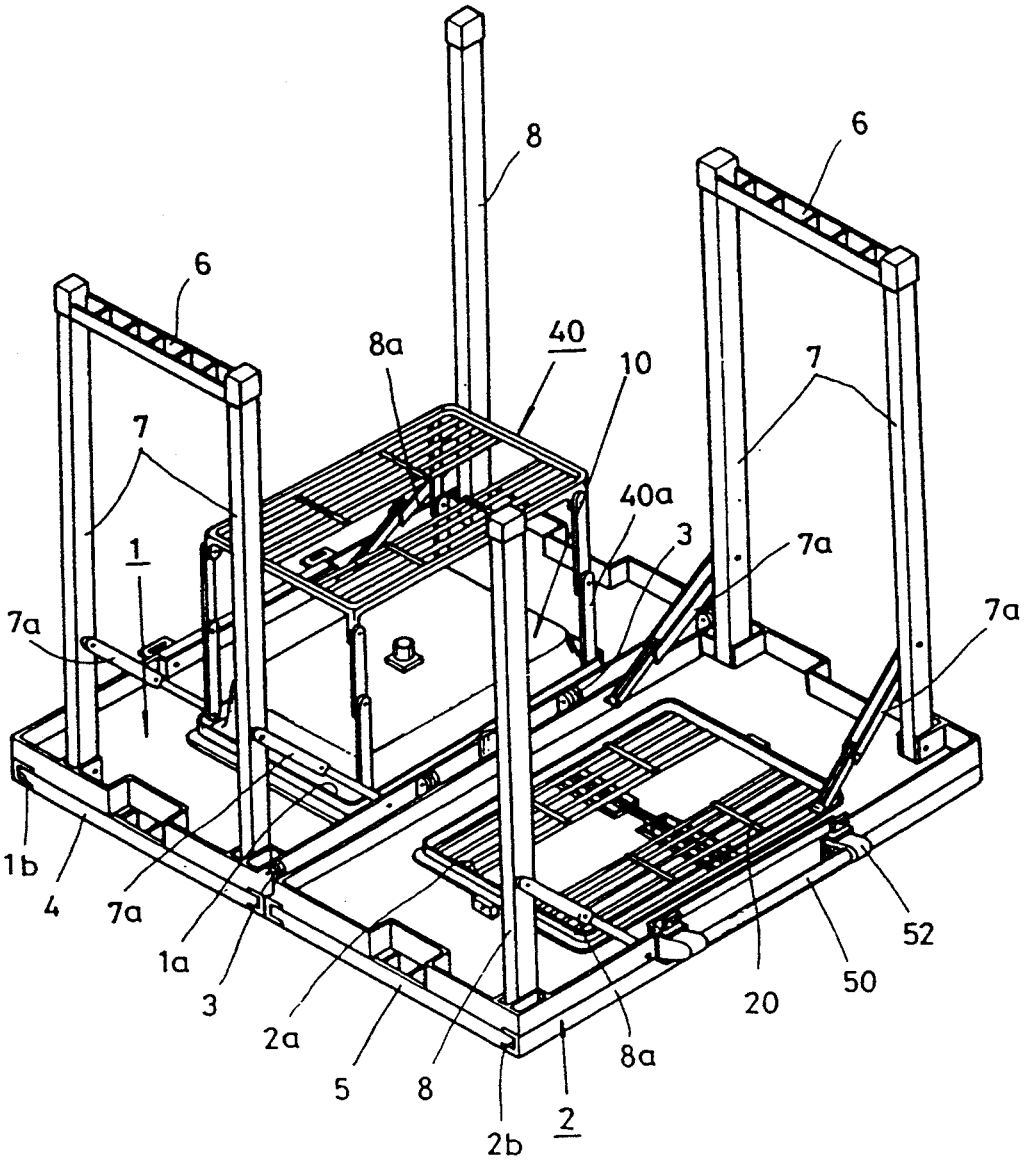
FIG. 2 is a perspective view of the foldable kitchen sink of FIG. 1 when overturned to show the bottom structure of the sink.
Figure 3:
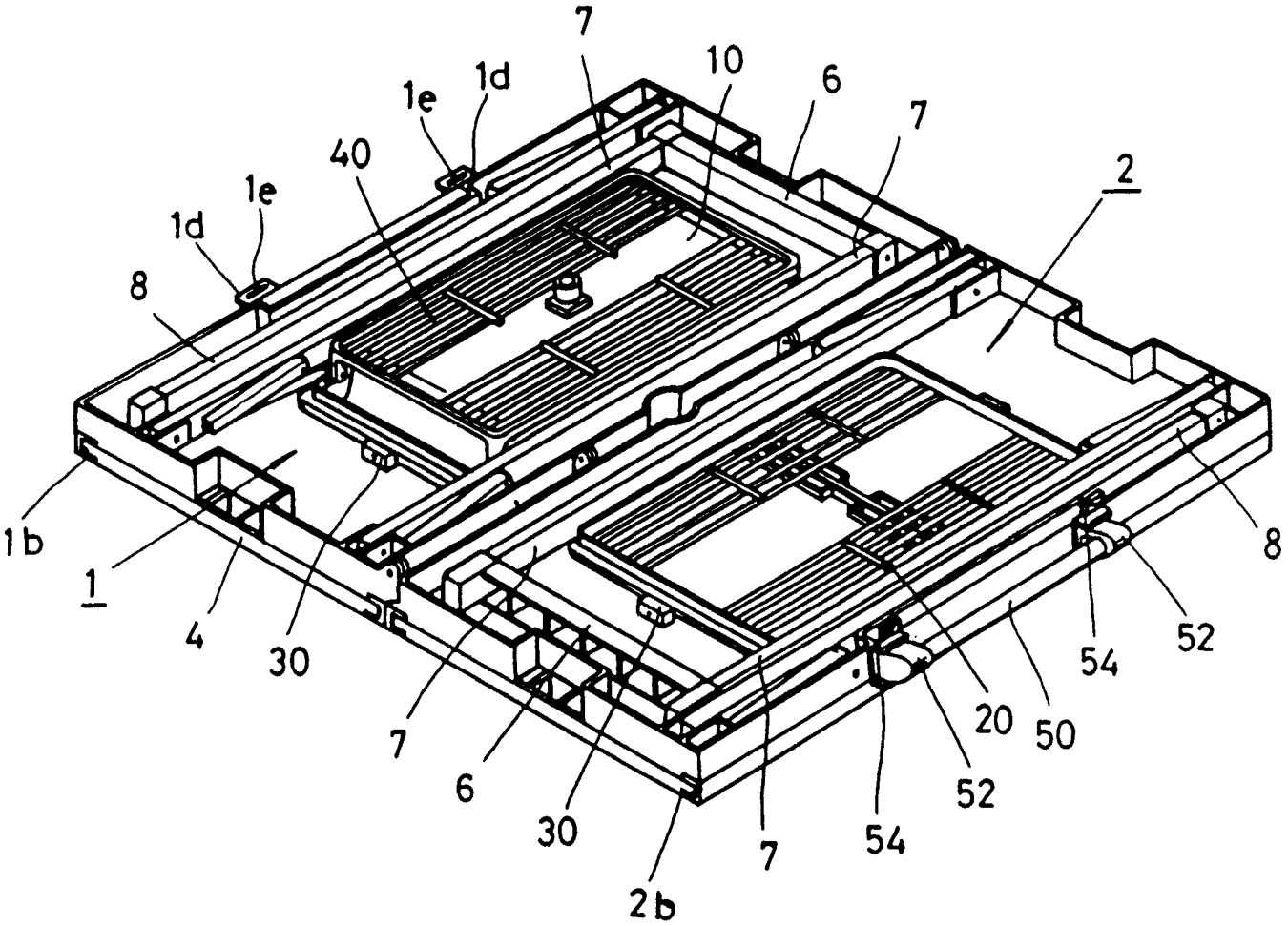
FIG. 3 is a bottom perspective view of the foldable kitchen sink of FIG. 2, showing legs and a grille type rack, both being folded.
Figure 4:
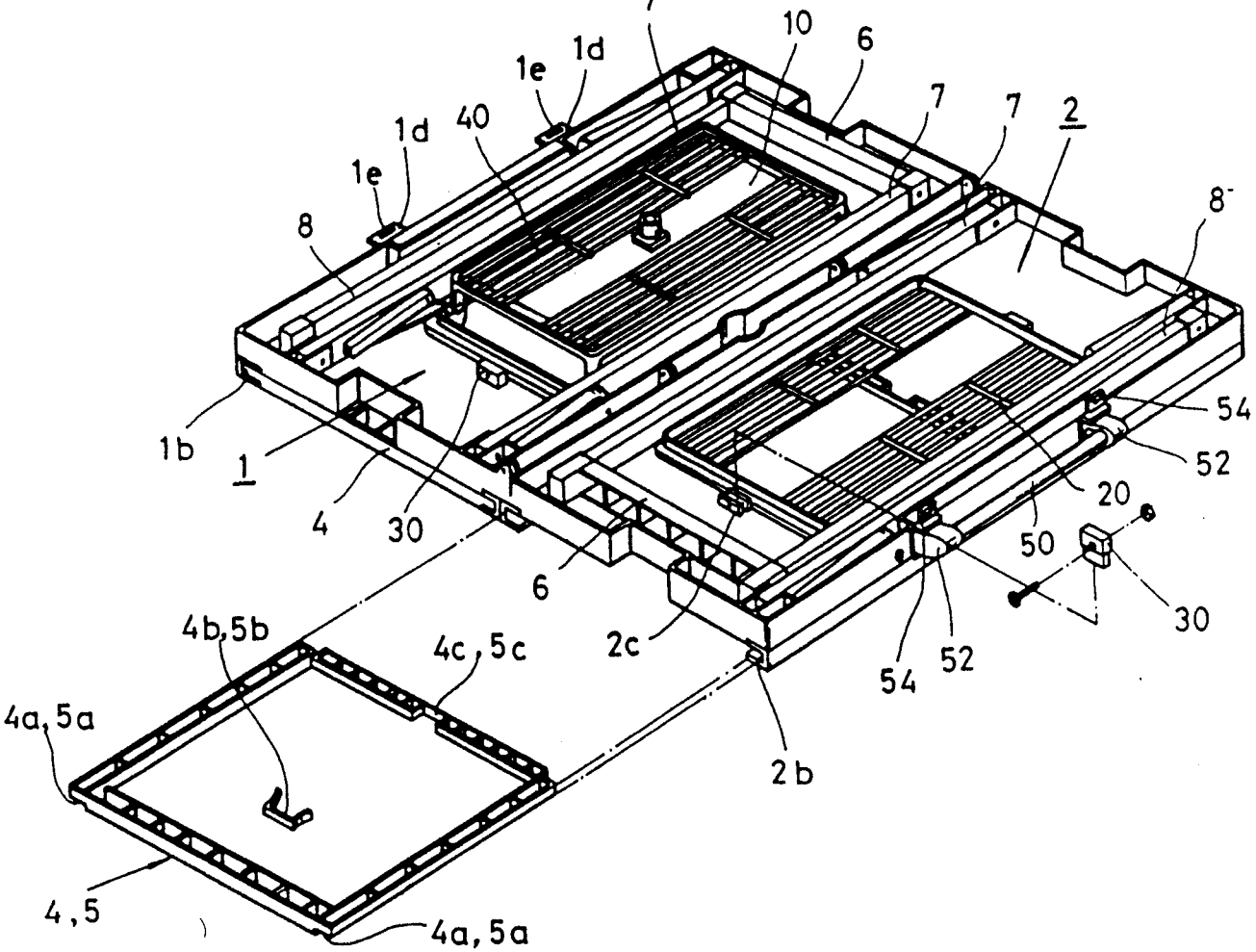
FIG. 4 is a bottom perspective view of the foldable kitchen sink of FIG. 2, showing an upper panel having a stopper separated from the folded sink.
Figure 6:
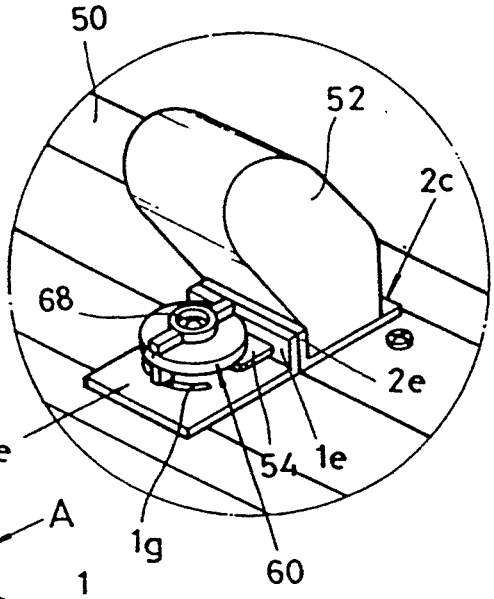
FIG. 6 is an enlarged perspective view of a locking unit shown at the circle A of FIG. 5.
Figure 5:
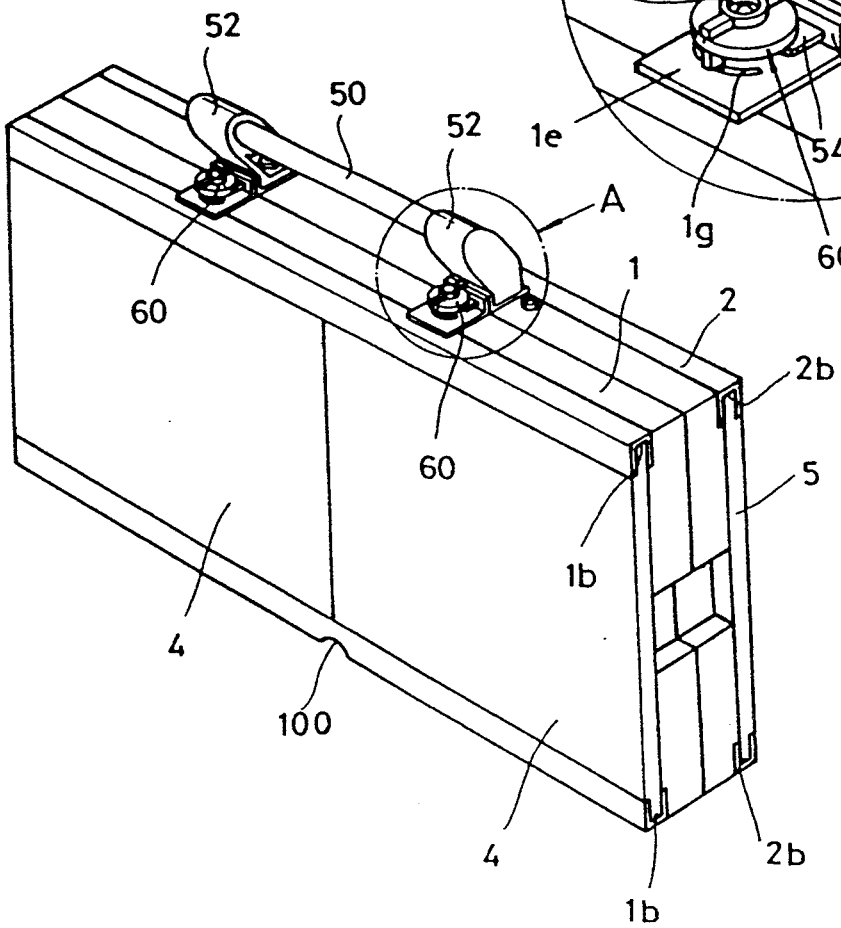
FIG. 5 is a perspective view of the foldable kitchen sink of FIG. 1, showing a profile of the completely folded sink wherein support members are folded and face each other, thus to compact the sink structure.

The two legs of the twin leg 7, which are connected at their lower ends to each other by the support beam 6 extending therebetween, and the single leg 8 are hinged at their upper tops to the lower surface of the member 1 or 2 as shown FIGS. 1 to 3. In order to support the twin leg 7 when it is completely unfolded, a link 7a is hinged at its both ends to an upper portion of each leg of the twin leg 7 and the upper panel 4 or 5. In the same manner, a link 8a is hinged at its both ends to an upper portion of the single leg 8 and the upper panel 4 or 5, thus to be completely stretched to support the unfolded state of the single leg 8. When the twin legs 7 and the single legs 8 are folded to face the lower surfaces of the upper panels 4 and 5 and to compact the foldable sink, the links 7a and 8a are folded inwardly as shown in FIG. 3.

The foldable sink of the present invention also includes a grille type rack 40 which is suspended below the rectangular hole 1a of the first support member 1 by four links 40a. This grille type rack 40 is used as a multipurpose rack when the links 40a are full stretched as shown in FIG. 2, however, comes into close contact with the lower surface of the dishwater bucket 10 by folding of the links 40a when it is required to compact the sink.

As shown in FIGS. 5 to 8, each of the front surfaces of the support members 1 and 2 is integrally provided with a pair of seats 1c or 2c spaced apart from each other by a distance. A handle fixing member 52 is fixed to each of the seats 2c of the second support member 2 for mounting a handle 50, while a rotary lock 60 is rotatably mounted on each of the seats 1c of the first support member 1 for locking the folded sink to retain the folded state of the sink.

Figure 7:
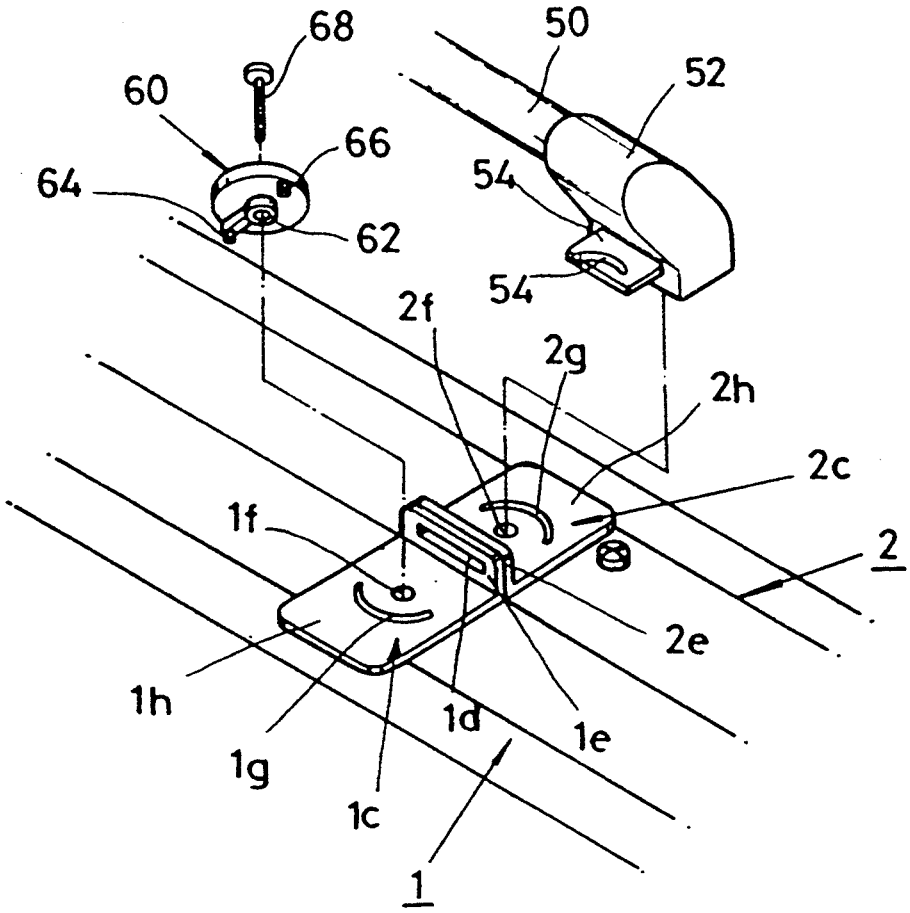
FIG. 7 is an exploded perspective view of the locking unit of FIG. 6.
Figure 8:
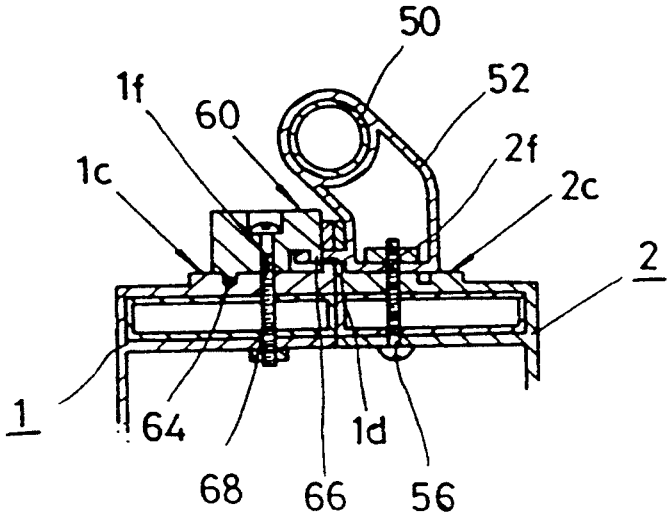
FIG. 8 is a cross sectional view of the locking unit of FIG. 6.
Figure 9:
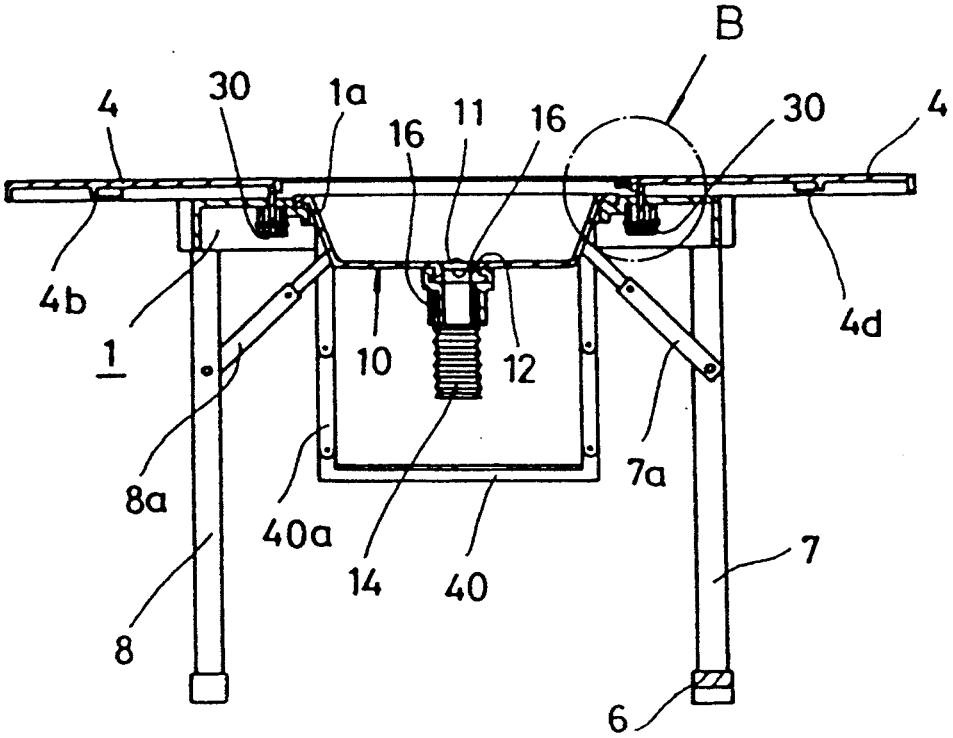
FIG. 9 is a cross sectional view of the foldable kitchen sink of FIG. 1.
Figure 10:
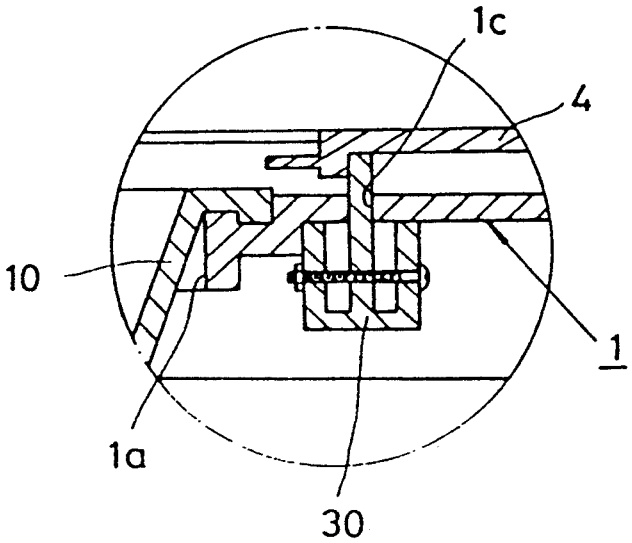
FIG. 10 is an enlarged perspective view of a portion shown at the circle B of FIG. 9.

The seats 1c and 2c have the same shape and each comprises an upright part 1e or 2e having a locking slit 1d or 2d. A horizontal part 1h or 2h integrally extends from the lower section of the upright part 1e or 2e and has a through hole 1f or 2f and an arcuate guide slot 1g or 2g. The handle fixing member 52 is integrally formed with a locking piece 54 having an arcuate locking slit 54a. The rotary rock 60 is provided with a center rotating hole 62 and has a guide protrusion 64 and a locking protrusion 66 on its lower surface, the protrusions 64 and 66 being diametrically opposed to each other. The rotary lock 60 is rotatably mounted on the seat 1c of the first support member 1 by a set screw 68, which passes through the center rotating hole 62 of the lock 60 and the through hole 1f of the seat 1c and tightened by a nut at its lower end. In this case, the guide protrusion 64 of the rotary lock 60 is received by the arcuate guide slot 1g such that it guides the rotation of the rotary lock 60 within a range defined by the arcuate guide slot 1g. In order to fix the handle fixing member 52 to the corresponding seat 2c of the second support member 2, the handle fixing member 52 is laid on the seat 2c such that its locking piece 54 having the arcuate locking slit 54a penetrates the locking slit 2d of the seat 2c to protrude from the locking slit 2d. In this state, the handle fixing member 52 is fixed to the seat 2c by a set screw 56 which passes through the through hole 2f of the seat 2c and tightened by a nut. When the two support members 1 and 2 are folded about the hinged connections 3 to face each other and to compact the foldable sink as shown in FIGS. 7 and 8, the locking piece 54 having the locking slit 54a penetrates the locking slit 1d of the upright part 1e of the seat 1c to protrude from this locking slit 1d. At this state, when the rotary lock 60 is rotated in the clockwise direction of FIG. 6, the guide protrusion 64 of the lock 60 is guided by the guide slot 1g and, at the same time, the locking protrusion 66 of the lock 60 is received by the arcuate locking slit 54a of the locking piece 54 of the handle fixing member 52. Thus, it is achieved the desired locking operation for retaining the compacted state of the foldable sink. On the contrary, when the rotary lock 60 is rotated in the counterclockwise direction of FIG. 7, the guide protrusion 64 of the lock 60 is guided by the guide slot 19 and, at the same time, the locking protrusion 66 of the lock 60 escapes from the arcuate locking slit 54a of the locking piece 54, thus to unlock the foldable sink and to allow this sink to be unfolded and practically used.

Figure 11:
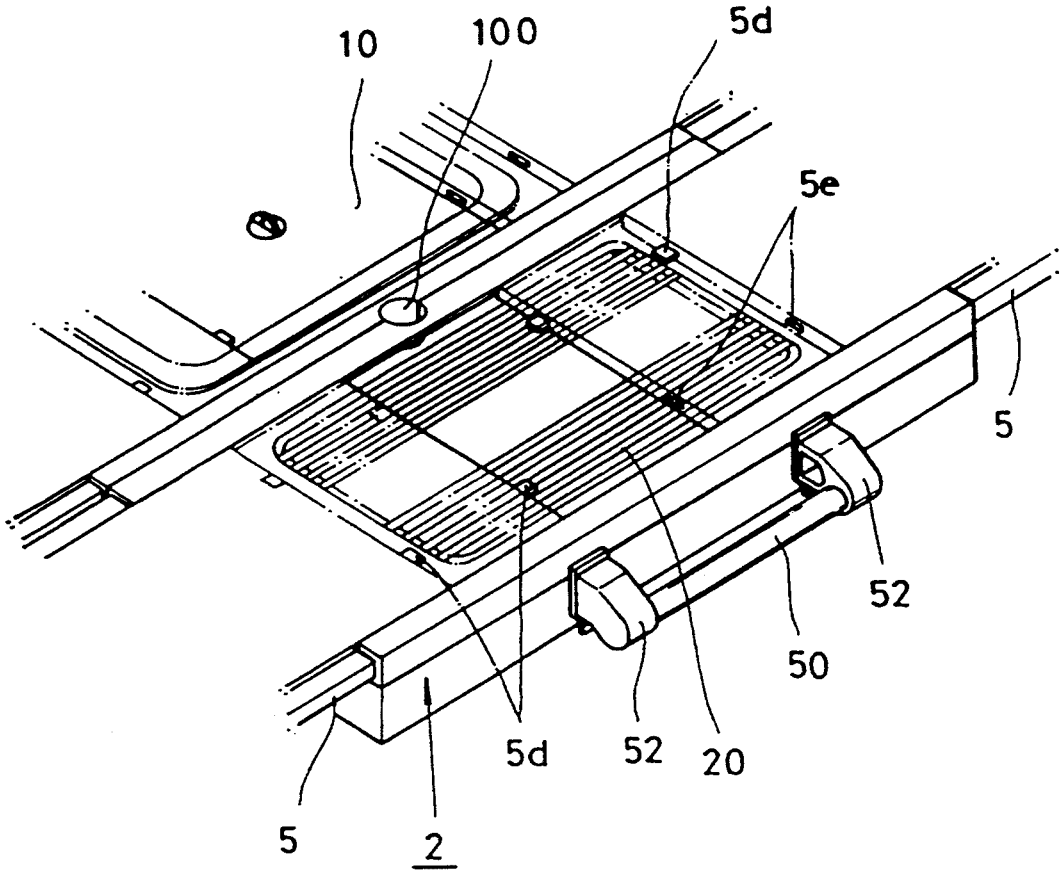
FIG. 11 is a partial perspective view of the foldable kitchen sink of FIG. 1, showing a linear slide reciprocation of the upper panels along guide frames.
Figure 12:
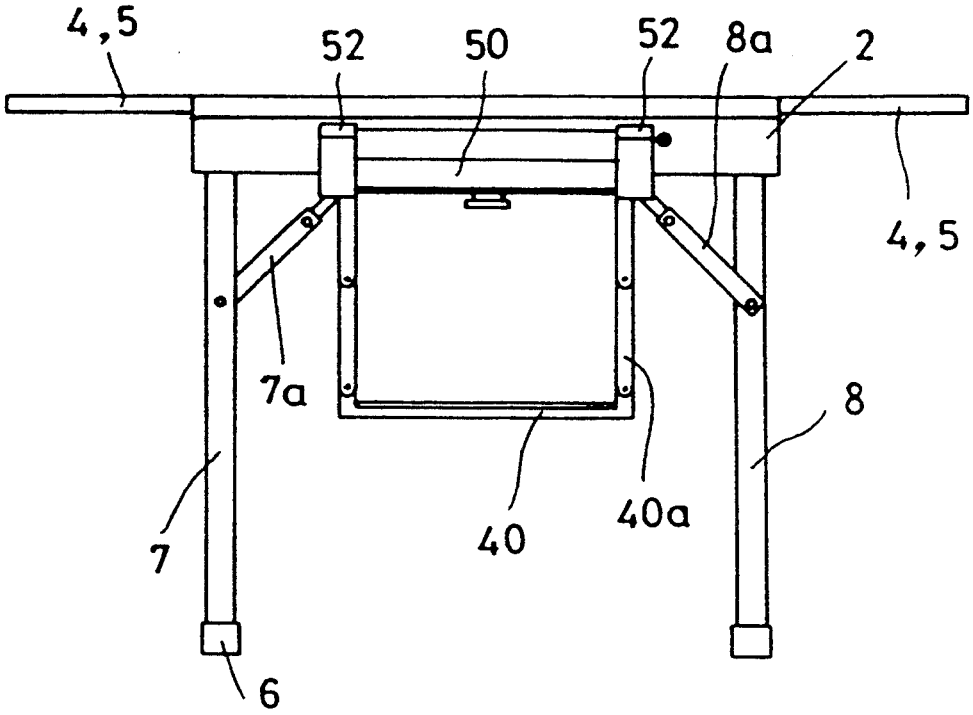

In FIG. 11, the reference numeral 100 denotes a hole for receiving a pole of a parasol.

Figure 17:
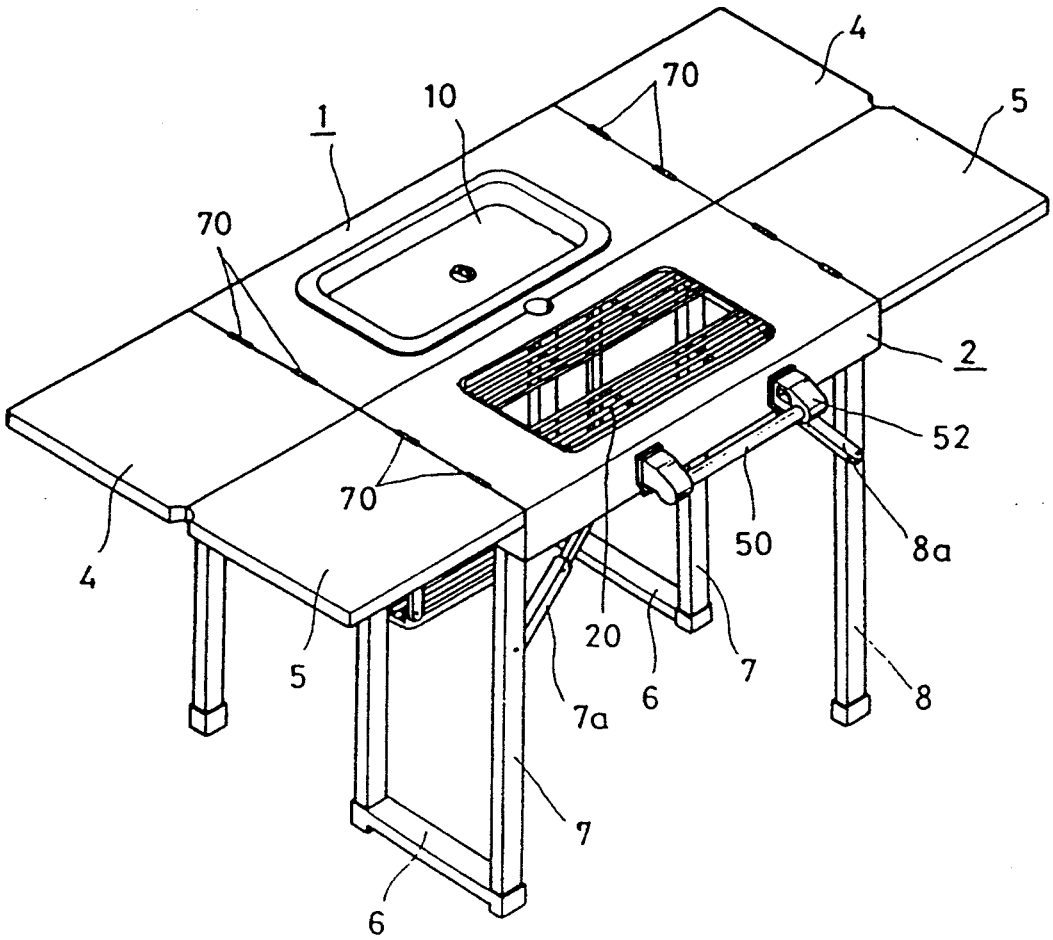
Figure 18:
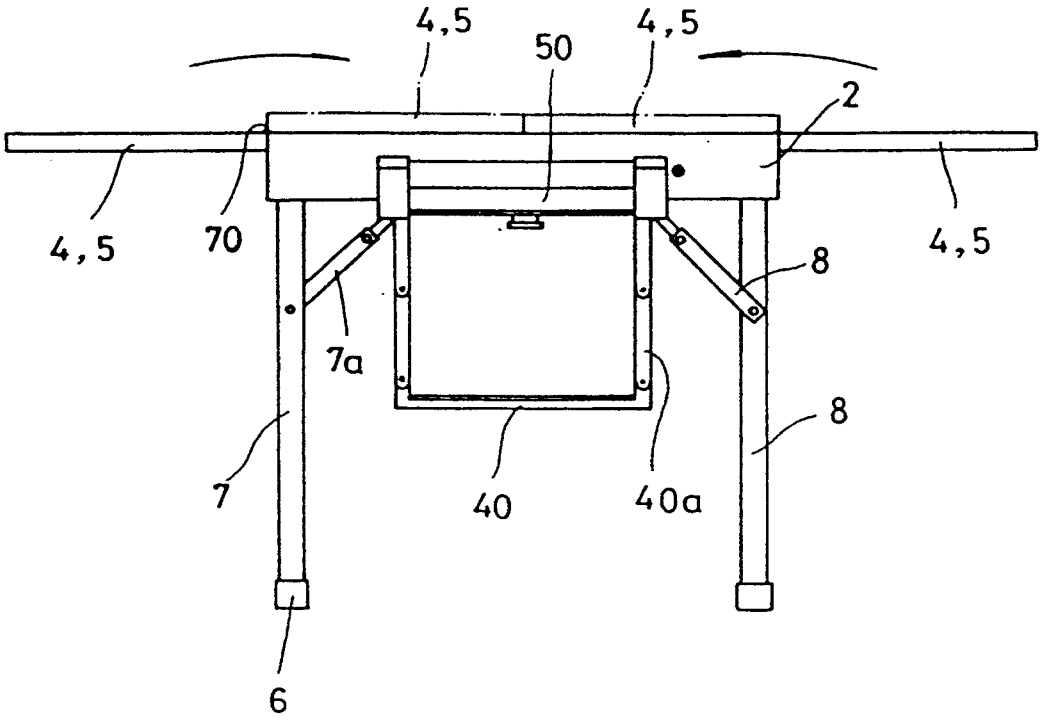

Turning to FIGS. 17 and 18, there is shown a foldable sink in accordance with a second alternate embodiment of the present invention. In this second alternate embodiment, the general shape of the sink remains the same as in the primary embodiment, but the upper panels 4 and 5 are hinged to the sides of the support members 1 and 2 by hinge connections 70, respectively. These panels 4 and 5 are folded about the hinge connections 70 to cover the dishwater bucket 10 and the grille 20. This sink according to the second alternate embodiment is used as a conventional sink when the panels 4 and 5 are spread out, but used as the multipurpose table when the panels 4 and 5 are folded to cover the dishwater bucket 10 and the grille 20, respectively. The other elements of this foldable sink than the above panels 4 and 5 are the same as those of the primary embodiment and further explanation is thus not deemed necessary.

FIGS. 19 to 28 shows a foldable sink in accordance with a third alternate embodiment of the present invention. In this third alternate embodiment, the support members 1 and 2, the upper panels 4 and 5, the combination structure of the handle fixing member with the lock, and the hinged connection structure of the legs to the support members are alternated as follows.

In this third embodiment, each of the support members 1 and 2 comprises a pair of parts 1' or 2' which are integrated into the member 1 or 2 by a pair of connection beams 80 connecting the opposed ends of the separated parts 1' or 2'.

Figure 19:
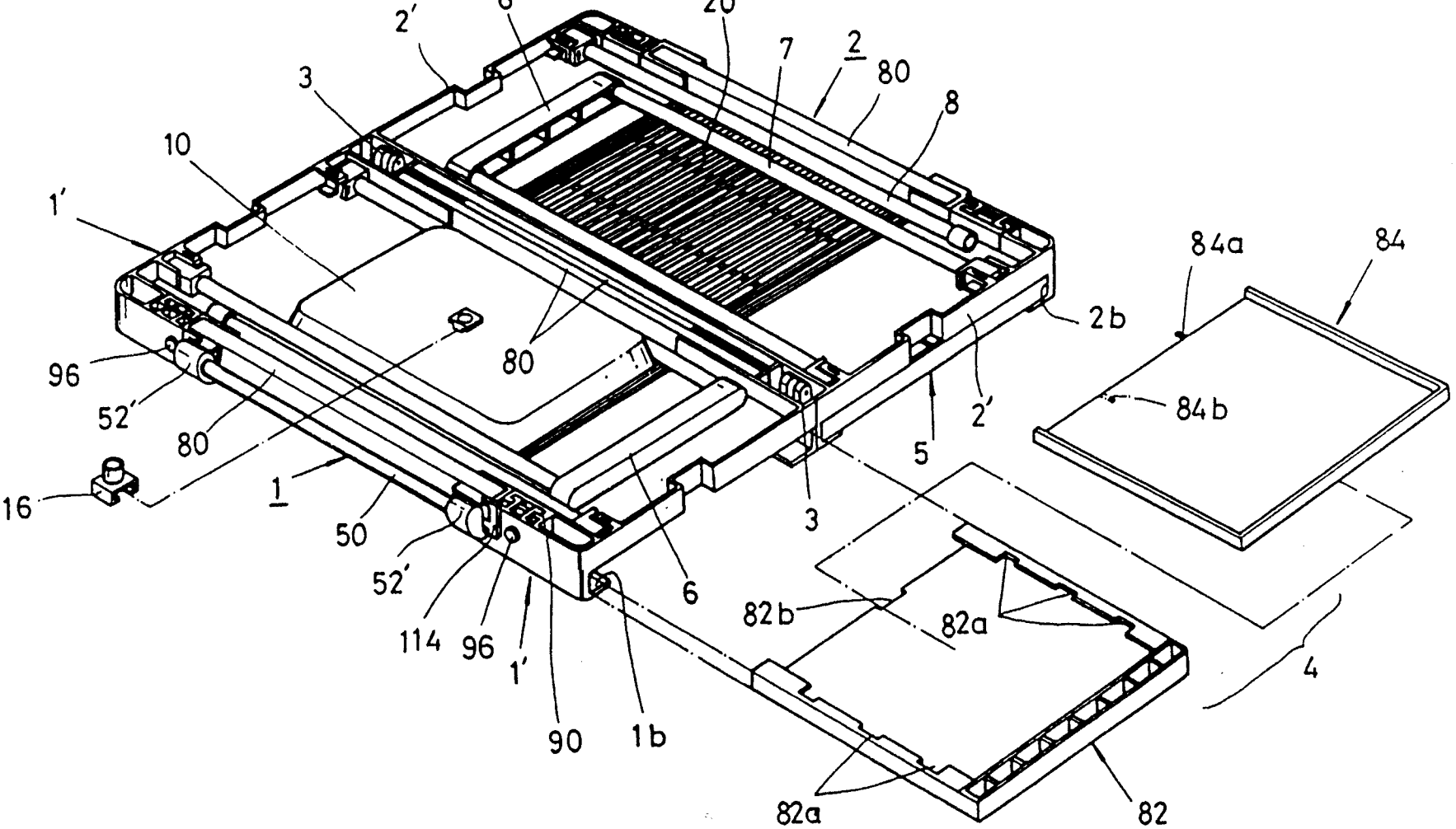
FIG. 19 is a partially exploded bottom perspective view of a foldable kitchen sink in accordance with a third embodiment of the present invention.
Figure 20:
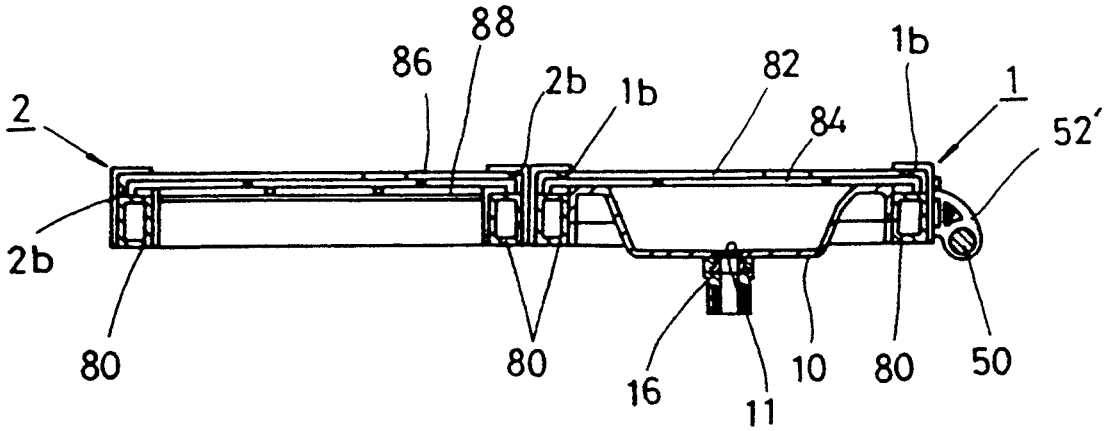
FIG. 20 is a partial sectional view of the foldable kitchen sink of FIG. 19.
Figure 21:
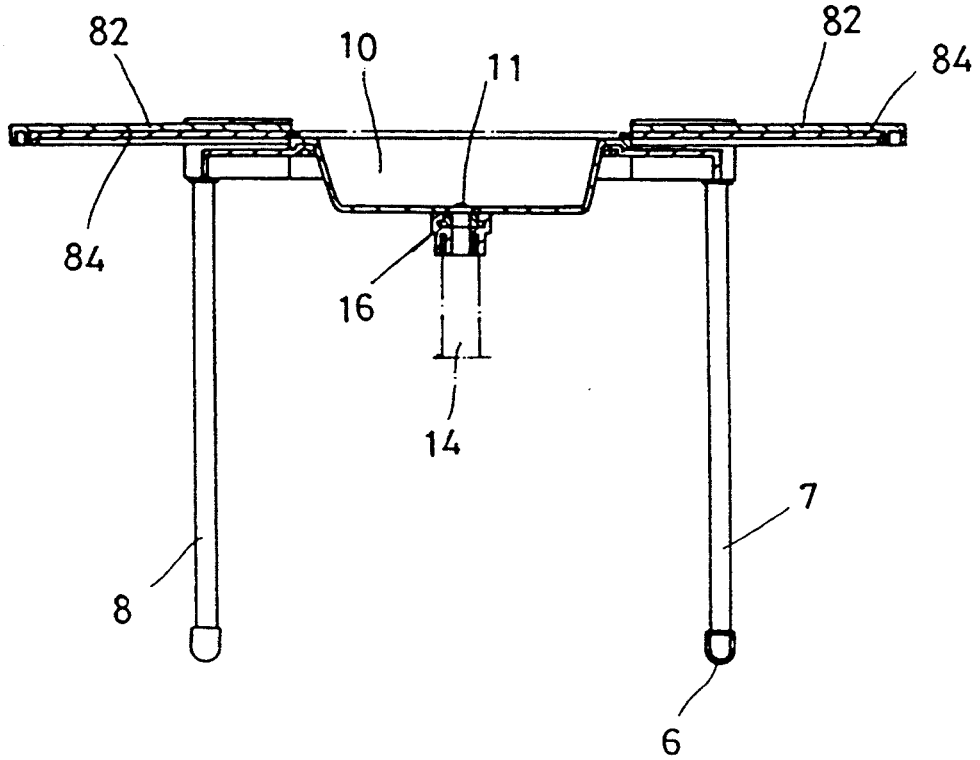
FIG. 21 is a cross sectional view of the foldable kitchen sink of FIG. 19 when completely unfolded.
Figure 22A:
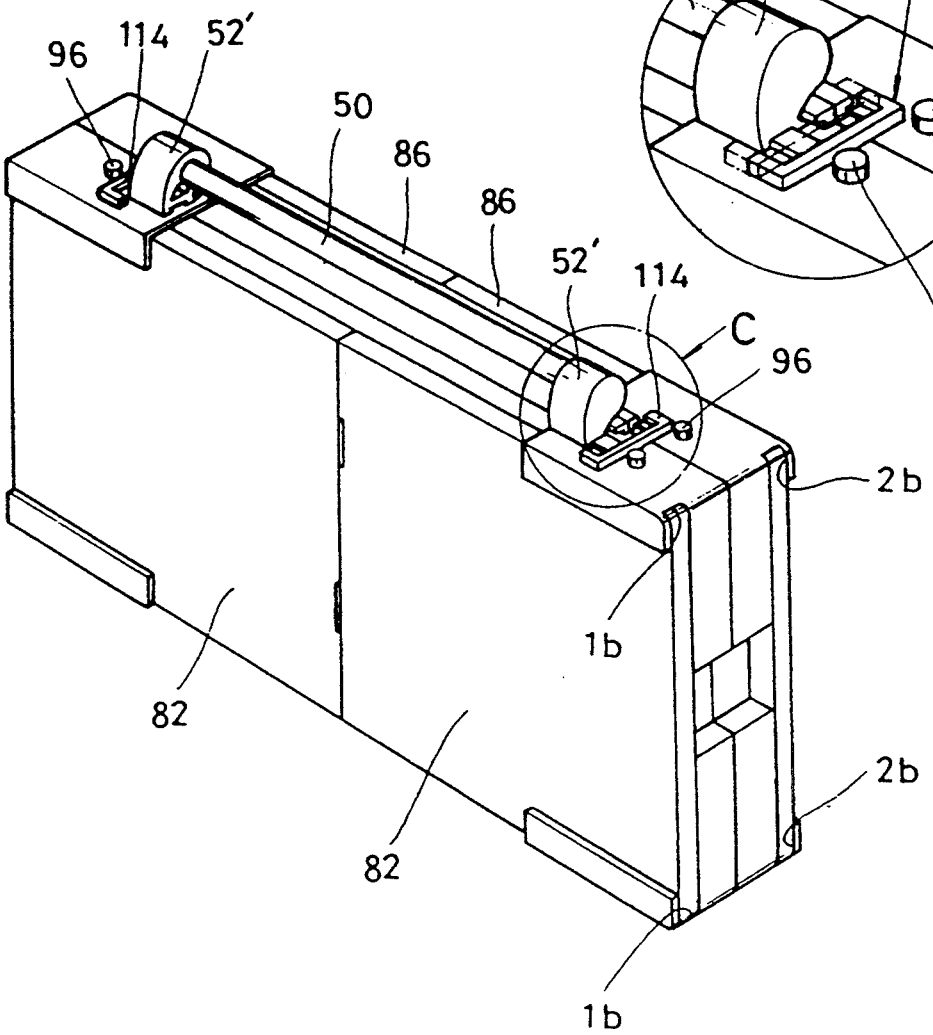
FIG. 22A is a perspective view of the foldable kitchen sink of FIG. 19, showing a profile of the sink in a completely folded state wherein the support members are folded and face each other, thus to compact the sink structure.
Figure 22B:
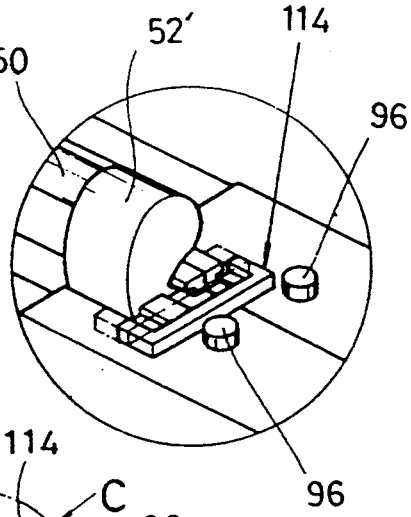
FIG. 22B is an enlarged perspective view of a locking unit shown at the circle C of FIG. 22A.

In addition, each of the upper panels 4 and 5 comprises an upper plate 82 or 86 and a lower plate 84 or 88. As best seen in FIG. 19, the lower plates 84 and 88 are slidably received in the upper plates 82 and 86, respectively, thus to constitute the panels 4 and 5. In the same manner as described for the primary embodiment, the panels 4 and 5 are slidably received by the guide rails 1b and 2b of the support members 1 and 2, respectively, so that the desired linear reciprocation of the panels 4 and 5 with respect to the support members 1 and 2 is achieved.

Here, each of the upper plate 82 and 86 has a plurality of lock notches 82*a* which are formed at opposite lower sides of the plate 82 or 86 and spaced apart from each other. A stop recess 82*b* is formed at the inner end of the plate 82 or 86. Each of the lower plate 84 or 88 has a coupling protrusion 84*a* and a coupling recess 84*b* which are formed at the inner end of the plate 84 or 88 and spaced apart from each other by a predetermined distance. This lower plate 84 or 88 also has a stop protrusion 84*c* (see FIG. 28) which protrudes from the upper surface of the plate 84 or 88 to cooperate with the stop recess 82*b* of the upper plate 82 or 86 to stop the slide movement of the lower plate 84 or 88 with respect to the upper plate 82 or 86.

Figure 23:
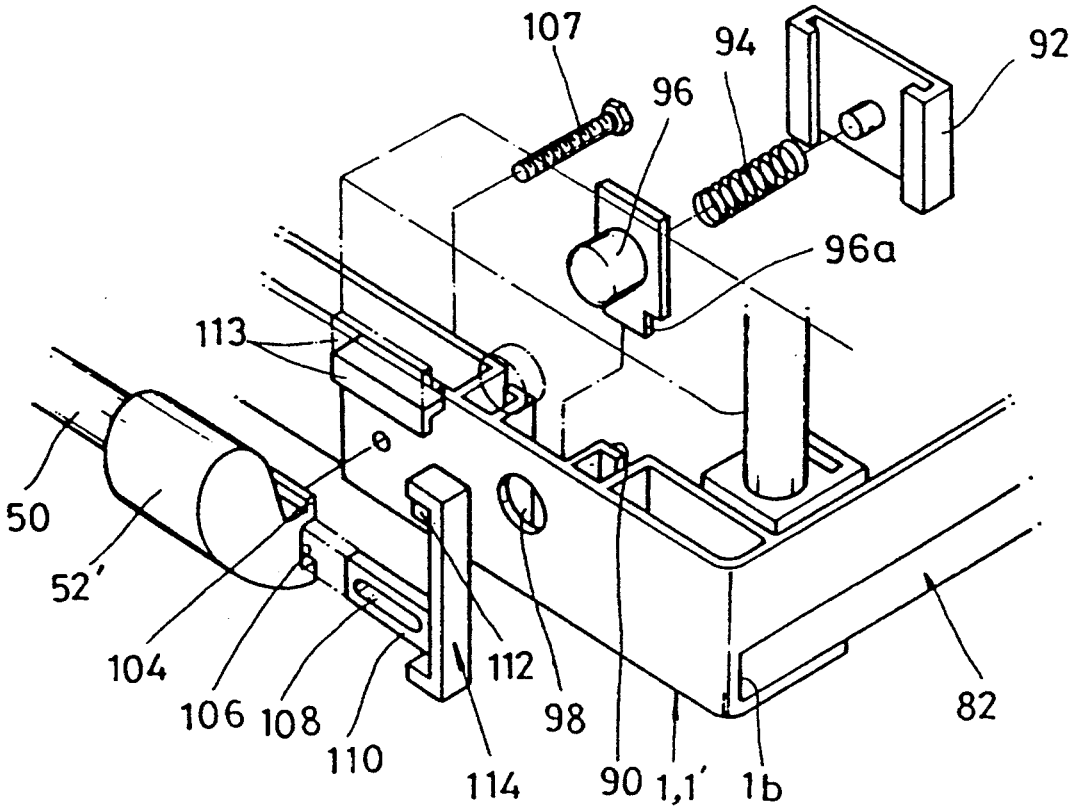
FIG. 23 is an enlarged exploded perspective view of the foldable kitchen sink of FIG. 19, showing a stopper and the locking unit.
Figure 24:
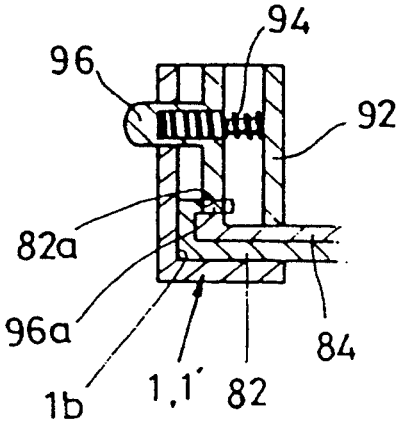
FIG. 24 is a sectional view of the stopper of FIG. 23.

In the support members 1 and 2, a panel locking unit,, comprising a support plate 92, a spring 94 and a push button 96, is provided in an inner support 90 as shown in FIGS. 19, 23 and 24. Here, the support plate 92 is mounted on the inner support 90, and the push button 96 is inserted into a hole 98 of the member 1 or 2 to protrude from the outer surface of the member 1 or 2 and biased by the compression coil spring 94 interposed between the plate 92 and the button 96. The push button 96 is integrally formed with a stopper 96*a* which intends to engage with one of the plurality of lock notches 82*a* of the upper plate 82 or 86. In order to allow the upper panel 4 or 5, or the upper plate 82 or 86 thereof, to slide along the support member 1 or 2, the push button 96 is elastically pushed to compress the compression coil spring 94 and to disengage the stopper 96*a* from the lock notch 82*a* of the upper plate 82 or 86, thus to allow a desired slide movement of the upper panel 4 or 5. When the desired slide movement of the panel 4 or 5 is achieved, the pushing force acting on the push button 96 is removed, thus to return the push button 96 to its initial position by the restoring force of the compression coil spring 94 and to make the stopper 96*a* of the button 96 engage with one of the lock notches 82*a* to fix the position of the panel 4 or 5. The reciprocation range of the upper plate 82 or 86 as well as of the lower plate 84 or 88 is thus controlled.

Figure 25:
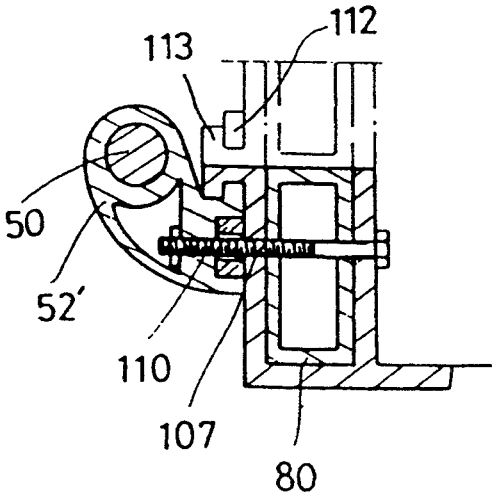
FIG. 25 is a sectional view of the locking unit of FIG. 23.

As shown in FIGS. 23 and 25, each of the parts 1' and 2' constituting the support members 1 and 2 has a L-shaped sectional hook 113 and the handle fixing member 52' is provided with a L-shaped sectional insert 104 and a guide groove 106, the insert 104 being adapted for engaging with the hook 113. The handle fixing member 52' is mounted on the part 1' of the support member 1 by a set screw 107. In order to mount the member 52' on the part 1', this member 52' is laid on the part 1' in such a manner that its insert 104 engages with the hook 113 of the part 1' and its guide groove 106 slidably receives a guide part 110 of a lock member 114 and, thereafter, the member 52' is fixed to the part 1' by the set screw 107. Here, the lock member 114 comprises the guide part 110, having a longitudinal opening 108, and a lock piece 112. When the handle fixing member 52' is mounted on the part 1' by the set screw 107, this set screw 107 passes through the longitudinal opening 108 of the guide part 110 of the lock member 114 such that the guide part 110 of the lock member 114 slidably reciprocates under the guide of the guide groove 106 of the member 52'. When the push lock member 114 is pushed or pulled, the lock piece 112 of the member 114 is locked to or released from the hook 113 of the part 2' of the second support member 2, thus to achieve the lock state or the release state of the completely folded sink.

Figure 26:
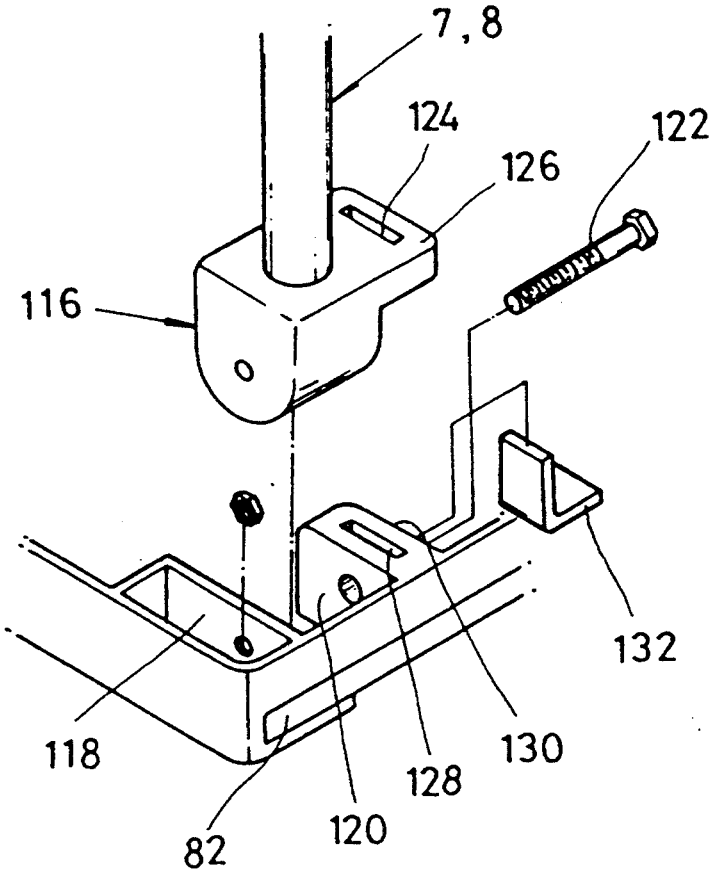
FIG. 26 is an exploded perspective view of a connection part of the sink of FIG. 19, the connection part connecting the leg to the support member.
Figure 27:
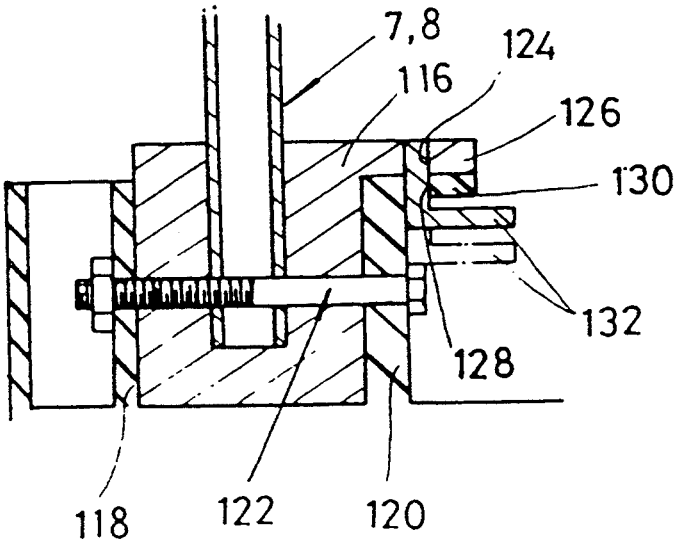
FIG. 27 is a sectional view of the connection part.
Figure 28:
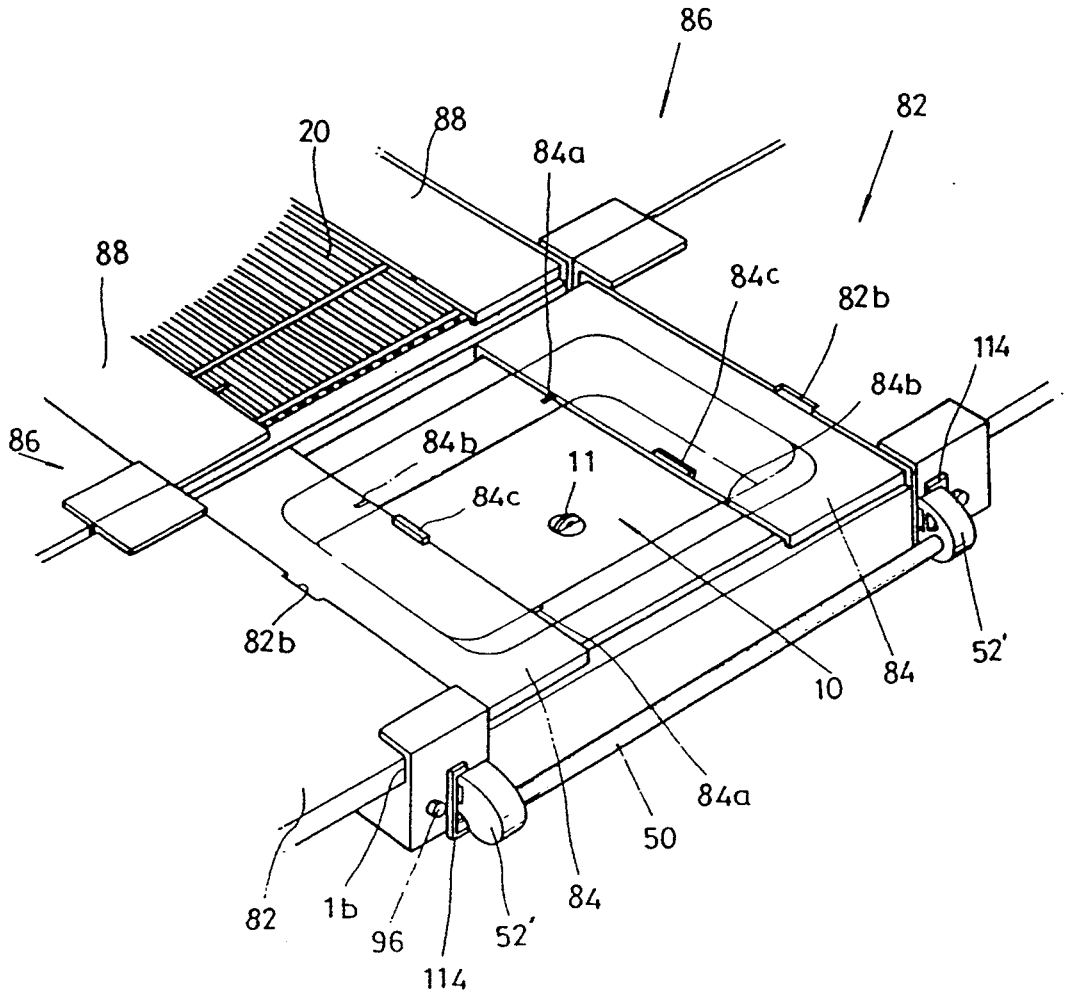
FIG. 28 is a partial perspective view of the foldable kitchen sink of FIG. 19, showing a slide operation of the upper and lower panels.

Turning to FIGS. 26 and 27, each of the legs 7 and 8 is hinged to the lower surface of the support member 1 or 2 using a turning member 116. This turning member 116 is fixed to the upper top of the leg 7 or 8 and placed between a pair of brackets 118 and 120 of the corresponding support member 1 or 2, and hinged to the brackets 118 and 120 by a hinge pin 122. The turning member 116 is integrally provided with a flange 126 having a fixing slit 124. In order to cooperate with the fixing slit 124, the mounting bracket 120 facing the flange 126 is integrally formed with a flange 130 having a fixing slit 128. An upright part of a L-shaped sectional lock 132 is received in the fixing slit 128 of the flange 130 such that it moves vertically. When the leg 7 or 8 is completely unfolded, the turning member 116 is turned about its hinged connection at about 90° such that the fixing slit 124 of its flange 126 is aligned with the fixing slit 128 of the bracket flange 130. At this state, the lock 132 is advanced vertically to insert its upright part into the fixing slit 124 of the flange 126, thus to fix the unfolded state of the leg 7 or 8. On the contrary, in order to fold the leg 7 or 8, the lock 132 is retracted to make its upright part escape from the fixing slit 124 of the flange 126. In the drawings, the leg 7 or 8 is shown as a circular sectional leg, however, it should be noted that there is no difference in using effect between the rectangular sectional leg of the primary embodiment and the circular sectional leg of this third embodiment.

Hereinbelow, the operational effect of the foldable kitchen sink of the present invention will be given with reference to the drawings.

When the foldable sink is completely unfolded to be used as a conventional sink as shown in FIG. 1, varieties of tablewares, including bowls and dishes, are washed in the dishwater bucket 10 provided on the first support member 1, and the washed tablewares are laid on the grille type rack 40 to be dried. On the other hand, the grille 20 provided on the second support member 2 provides a place for a cooking heater, such as a gas range. At this time, the latitudinal opening 22 defined in the grille 20 allows fuel supplying means (not shown ), for example, a gas hose for supplying the gas to the gas range, to pass therethrough. In addition, the grille 20 comprises the plurality of latitudinal bars 21 and the plurality of longitudinal bars 22 which cross with each other to provide spaces, so that the heat generated by the cooking heater is efficiently dispersed and gives no bad effect to the sink.

When the sink is used as a conventional sink, the upper panels 4 and 5, which are provided at the sides of the dishwater bucket 10 and of the grille 20, are used as tables, such as for supporting the tablewares.

Figure 13:
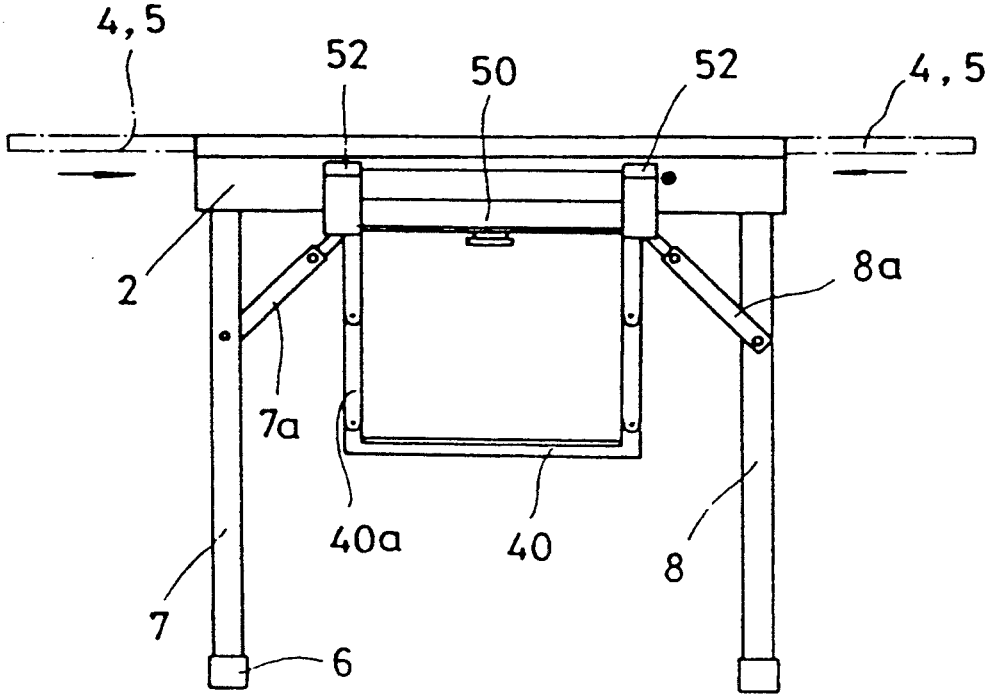

The foldable sink of this invention can be used as a multipurpose outdoor table other than a conventional sink. In order to use the sink according to the primary embodiment as the table, all of the upper panels 4 and 5 slide inwards as shown in FIGS. 2 and 13 such that the coupling protrusions 4*d* and 5*d* of the panels 4 and 5 are inserted into the coupling recesses 4*e* and 5*e*, respectively, and the dishwater bucket 10 and the grille 20 are covered with the first panels 4 and the second panels 5, respectively. At this time, the guide rails of the support members 1 and 2 are leveled with the upper surfaces of the upper panels 4 and 5, so that the foldable sink is used as the table.

In the foldable sink in accordance with the second embodiment of FIGS. 17 and 18, the upper panels 4 and 5, which are hinged to the sides of the support members 1 and 2 by the hinge connections 70, are spread out as shown in FIG. 17 to be used as a conventional sink. When the panels 4 and 5 are folded to cover the dishwater bucket 10 and the grille 20, respectively, this sink is used as a table.

Figure 14:
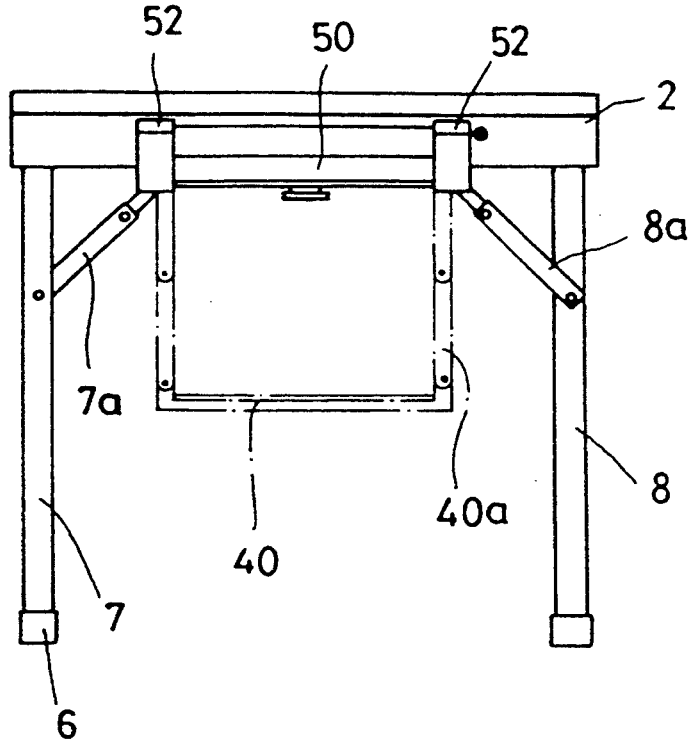
Figure 15:
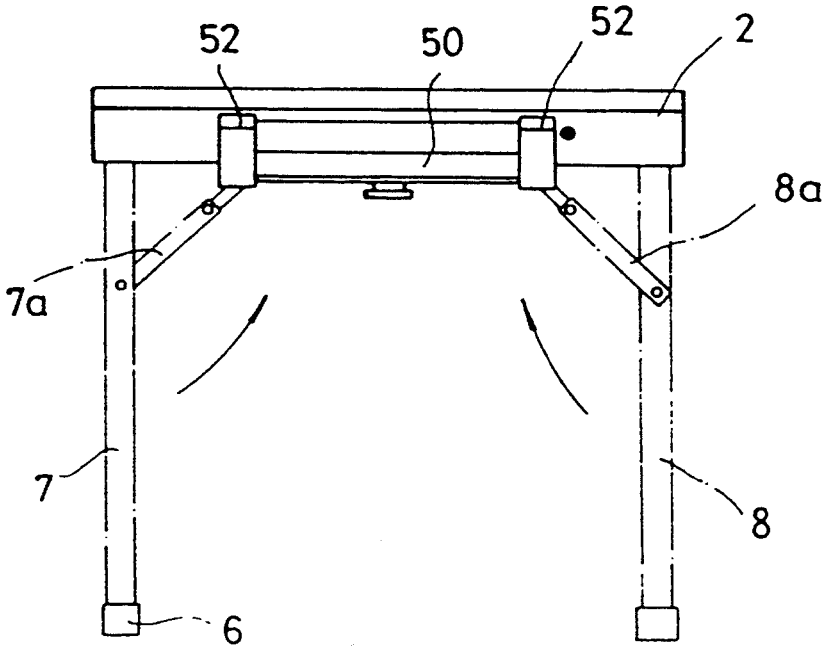
Figure 16:
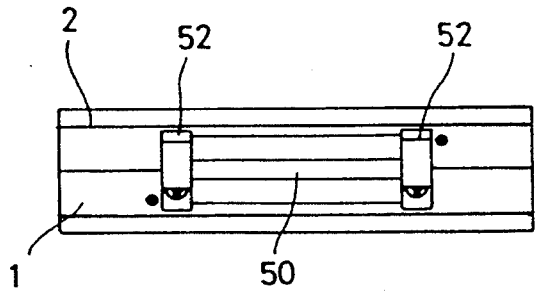

In order to fold the sink to be carried with one, the panels 4 and 5 of the primary embodiment slide inwards as shown in FIG. 13, thus to achieve the table shape. Thereafter, the grille type rack 40, which is suspended below the dishwater bucket 10 of the first support member 1 by the four links 40*a*, is folded to come into close contact with the lower surface of the dishwater bucket 10 by folding the links 40*a* as shown in FIG. 14. The links 7*a* and 8*a* are, thereafter, folded inwardly and twin legs 7 and the single legs 8 are folded to face the lower surfaces of the upper panels 4 and 5 as shown in FIG. 15. The first and second support members 1 and 2 are in turn folded about the hinge connections 3 closely face each other with the dishwater bucket 10, the grille 20, the grille type rack 40 and the legs 7 and 8 which are interposed between the support members 1 and 2. Thereafter, the rotary locks 60, rotatably mounted on the seats 1*c* of the first support member 1 neighboring the handle fixing members 52, are rotated in the clockwise direction of FIG. 6, the guide protrusion 64 of the lock 60 is guided by the guide slot 1*g* and, at the same time, the locking protrusion 66 of the lock 60 is received by the arcuate locking slit 54*a* of the locking piece 54 of the handle fixing member 52. Thus, it is achieved the desired locking state for retaining the compacted state of the foldable sink as shown in FIG. 16. The compacted sink of FIG. 16 can be easily carried with one alike a conventional suitcase.

The foldable sink of the second embodiment of FIGS. 17 and 18 can be folded in the similar manner as described for the primary embodiment. In the folding process of this sink, the panels 4 and 5 do not slide inwards but are folded about the hinge connections 70. Further explanation is thus not deemed necessary.

When the foldable sink according to the third embodiment of FIGS. 19 to 28 is to be used as a conventional sink, the upper and lower plates 82, 84, 86 and 88 of the upper panels 4 and 5 slide outwards with respect to the support members 1 and 2, thus to expose the dishwater bucket 10 and the grille 20 to the outside. On the contrary, when it is required to use this sink as a table, all of the upper panels, comprising the upper and lower plates 82, 84, 86 and 88, or only the lower plates 84 and 88 slide inwards with respect to the support members 1 and 2, thus to cover the dishwater bucket 10 and the grille 20. Especially, this third embodiment enlarges the table surface when the lower plates 84 and 88 slide inwards but the upper plates 82 and 86 slide outwards.

In order to fold the sink of this third embodiment to be carried with one, all of the upper and lower plates 82, 84, 86 and 88 of the upper panels slide inwards to cover the dishwater bucket 10 and the grille 20. Thereafter, the lock 132 is retracted to make its upright part escape from the fixing slit 124 of the flange 126, and the legs 7 and 8 are folded to face the lower surface of the support members 1 and 2. The first and second support members 1 and 2 are in turn folded about the hinge connections 3 to closely face each other with the dishwater bucket 10, the grille 20, the grille type rack 40 and the legs 7 and 8 which are interposed between the support members 1 and 2. Thereafter, the push lock member 114 is pushed to lock the lock piece 112 of the member 114 to the hook 113 of the part 2' of the second support member 2, thus to achieve the lock state of the folded sink. The compacted sink of FIG. 22 can be easily carried with one alike a conventional suitcase.

Of course, the sink of the third embodiment is unfolded in the reversed course, however, it should be noted that the sink may be unfolded by another course as desired.

As described above, a foldable kitchen sink according to the present invention can be used as a conventional outdoor sink or as a multipurpose outdoor table, and simplifies its folding structure and reduces its folded thickness, thus to be simply folded and unfolded, to achieve the recent trend of lightness and compactness of the portable sink, and to facilitate its management when folded and carried with one.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A foldable kitchen sink comprising:

a pair of support members, each having an upper and lower surface, said members being hinged to each other such that said upper surfaces may be deployed in a facing folded position or in a generally coplanar unfolded position, one of said support members having a dishwater bucket detachably mounted thereto and the other of said support members having a grille detachably mounted thereto;

a pair of upper panels attached to two sides respectively of each said support member such that said panels may selectively cover said dishwater bucket or said grille respectively in a folded position;

a pair of twin legs and a pair of single legs, one of each hinged to said lower surface of each said support member such that in said unfolded position said twin legs are diagonally opposed to each other and said single legs are diagonally opposed to each other, said twin legs and said single legs being foldable onto said lower surfaces, and each of said twin legs comprising two legs connected to each other by a support beam extending therebetween.

2. The foldable kitchen sink according to claim 1, wherein said grille comprising a plurality of latitudinal bars and a plurality of longitudinal bars which cross with each other such that a center opening is defined at the center of said grille.

3. The foldable kitchen sink according to claim 1, wherein each of said upper panels is integrally provided with stepped sides and a stopping protrusion, and a stopping recess, said stopping protrusion and said stopping recess being spaced apart from each other by a predetermined distance; and each of said support members has a pair of guide rails for receiving individual stepped sides of said upper panel to achieve a slidable engagement of said upper panel with said support member as well as to level an upper surface of said upper panel with upper surfaces of said guide rails, each of said support members having a stopper for cooperating with said stopping protrusion and said stopping recess of said upper panel to limit a slide reciprocation of said panel.

4. The foldable kitchen sink according to claim 1 or 3, wherein facing sides of said pair of upper panels are provided with a pair of coupling protrusions and a pair of coupling recesses, respectively, said coupling protrusions being inserted into said coupling recesses when said upper panels closely face each other, thus to couple said panels to each other.

5. The foldable kitchen sink according to claim 1, further comprising a grille type rack suspended below a rectangular hole of one of said support members by a plurality of connection links, said rectangular hole being formed to receive one of said dishwater bucket and said grille.

6. The foldable kitchen sink according to claim 1, further comprising:

two pairs of seats provided on front surfaces of said support members, said seats having the same shape and each comprising:

an upright part having a locking slit; and a horizontal part integrally extending from said upright part and having a through hole as well as an arcuate guide slot;

a handle fixing member fixed to each of said seats provided on one of said support members for mounting a handle, said handle fixing member being integrally formed with a locking piece having an arcuate locking slit;

a rotary lock rotatably mounted on each of said seats provided on the other of said support members for locking the folded sink to retain a folded state of said sink, said rotary rock having:

a center rotating hole; and a guide protrusion and a locking protrusion provided on a lower surface of said rotary lock such that they diametrically opposed to each other, whereby said guide protrusion is guided by said arcuate guide slot of said seat, and said locking protrusion is received by said arcuate locking slit of said handle fixing member, thus to achieve a desired locking operation for retaining said folded state of said sink.

7. The foldable kitchen sink according to claim 1, where in said upper panels are hinged to said side ends of said support members by a plurality of hinge connections, said upper panels being folded about said hinge connections to cover said dishwater bucket and said grille.

8. The foldable kitchen sink according to claim 1, wherein each of said support members comprises a pair of parts which are integrated into said member by a pair of connection beams connecting opposed ends of said parts to each other.

9. The foldable kitchen sink according to claim 3, wherein each of said upper panels comprises an upper plate and a lower plate, said lower plate being slidably received in said upper plates, and said panels being slidably received by said guide rails of said support members, so that said slide reciprocation of said panels with respect to said support members is achieved.

10. The foldable kitchen sink according to claim 8 or 9, further comprising:

a panel locking unit being provided in an inner support of each of said support members, said locking unit comprising a support plate, a spring and a push button, said push button being integrally formed with a stopper;

a plurality of lock notches formed at opposite lower sides of said upper plate of said upper panel and spaced apart from each other;

a stop recess formed at an inner end of said upper plate;

a coupling protrusion and a coupling recess which are formed at an inner end of said lower plate and spaced apart from each other by a predetermined distance; and a stop protrusion protruding from an upper surface of said lower plate for cooperating with said stop recess of said upper plate, whereby a slide movement of said lower plate with respect to said upper plate is controlled.

11. The foldable kitchen sink according to claim 8, wherein each of said parts having a L-shaped sectional hook;

said handle fixing member is provided with a L-shaped sectional insert and a guide groove, said insert being adapted for engaging with said L-shaped sectional hook; and said handle fixing member is mounted on one of said parts of said support member by a set screw in such a manner that its L-shaped sectional insert engages with said L-shaped sectional hook and its guide groove slidably receives a guide part of a lock member, said lock member comprising said guide part having a longitudinal opening, and a lock piece, said set screw passing through a longitudinal opening of said guide part of said lock member such that said guide part of said lock member slidably reciprocating under the guide of said guide groove of said handle fixing member, whereby said lock member is pushed to cause its lock piece to be locked to said hook, thus to achieve a lock state of said folded sink.

12. The foldable kitchen sink according to claim 1 or 8, further comprising:

a turning member hinging each of said twin legs and said single legs to the lower surface of said support member, said turning member being fixed to an upper top of said leg and placed between a pair of brackets of a corresponding member, and hinged to said brackets by a hinge pin, said turning member being integrally provided with a flange a fixing slit;

said mounting bracket being integrally formed with a flange having a fixing slit, said fixing slit cooperating said fixing slit of said turning member; and a L-shaped sectional lock being received in said fixing slit of said mounting bracket such that it moves vertically, said lock advancing vertically to insert its upright part into said fixing slit of said turning member and to fix an unfolded state of said leg.

* * * * *